US005460371A

United States Patent [19]

Takeda

[11] Patent Number: 5,460,371

[45] Date of Patent: Oct. 24, 1995

[54] GOLF CLUB WOOD HEAD

[75] Inventor: Hitoshi Takeda, Tsubame, Japan

[73] Assignee: Kabushiki Kaisha Endo Seisakusho, Japan

[21] Appl. No.: 358,193

[22] Filed: Dec. 16, 1994

Related U.S. Application Data

[62] Division of Ser. No. 245,874, May 19, 1994.

[30] Foreign Application Priority Data

| | | | |
|---|---|---|---|
| May 31, 1993 | [JP] | Japan | 5-129620 |
| May 19, 1993 | [JP] | Japan | 5-117328 |
| Dec. 28, 1993 | [JP] | Japan | 5-334330 |
| Feb. 18, 1994 | [JP] | Japan | 6-21399 |
| Feb. 22, 1994 | [JP] | Japan | 6-24319 |
| Feb. 28, 1994 | [JP] | Japan | 6-30240 |
| Mar. 7, 1994 | [JP] | Japan | 6-35844 |
| Apr. 5, 1994 | [JP] | Japan | 6-67365 |
| Apr. 6, 1994 | [JP] | Japan | 6-68786 |

[51] Int. Cl.[6] ..... A63B 53/02; A63B 53/04

[52] U.S. Cl. ..... 273/80.2; 273/167 H

[58] Field of Search ..... 273/167 R, 167 A, 273/167 F, 167 G, 167 H, 167 J, 167 K, 169, 173, 174, 80 C, 79, 77 R, 80.1, 80.2, 80.3, 80.4, 80.5, 80.6, 80.7, 80.8, 193 R, 194 R, 162 R, 80 R

[56] References Cited

U.S. PATENT DOCUMENTS

| | | | |
|---|---|---|---|
| 1,250,301 | 12/1917 | Goodrich | 273/79 |
| 1,559,299 | 10/1925 | Barach | 273/80.7 |
| 1,575,364 | 3/1926 | Hodgkins | 273/80.2 |
| 3,212,783 | 10/1965 | Bradley | 273/80.2 |
| 4,023,802 | 5/1977 | Jepson | 273/173 |
| 4,121,832 | 10/1978 | Ebbing | 273/173 |
| 4,438,931 | 3/1984 | Motomiya | 273/80.2 |
| 5,149,091 | 9/1992 | Okumoto | 273/167 R |
| 5,232,224 | 8/1993 | Zeider | 273/80.2 |
| 5,346,217 | 9/1994 | Tsuchiya | 273/167 R |

FOREIGN PATENT DOCUMENTS

| | | |
|---|---|---|
| 58-185252 | 12/1983 | Japan . |
| 63-154186 | 6/1988 | Japan . |

*Primary Examiner*—Sebastiano Passaniti
*Attorney, Agent, or Firm*—Quarles & Brady

[57] ABSTRACT

A metallic golf club wood head comprises a substantially planar face member welded to a container-shaped rear shell member having an open front face. A shaft connecting portion 7*a* is forged integrally with an upper portion of the face member 11*a*. A cut-out 14*a* is formed in an upper face of a front side of a rear shell member 12*a* for accommodating a lower portion of the shaft connecting portion 7*a*. As a result of this construction the number of structural members is reduced and the strength of the shaft connecting portion 7*a* is increased. Furthermore, the loft angle can be adjusted when manufacturing the face member 11*a* for example by forging. Moreover, since it is sufficient for the shaft connecting portion 7*a* to be formed at the top of the head only, the front side of the head can be lightened and the "sweet area" increased.

3 Claims, 5 Drawing Sheets

GOLF CLUB WOOD HEAD

CROSS REFERENCE TO RELATED APPLICATIONS

This application is a divisional application of U.S. Ser. No. 245,874 filed on May 19, 1994, now pending.

BACKGROUND OF THE INVENTION (a) Field of the Invention

The present invention relates to a hollow metallic golf club head of the so-called "wood" head type.

(b) Description of the Prior Art

Golf club wood heads having a hollow metallic head body as disclosed for example in Japanese Unexamined Patent Publication No. 63-154186 are known, and are referred to as "metal woods". With the head disclosed in this publication, the head body is constructed by welding together two or three forged shell members. The divisions may be for example into three sections, namely a face, sole, toe, and heel section, a back section, and a top section, or into two sections, namely a front section and rear section formed by a dividing line between sole, toe, heel, and top portions. A shaft connection pipe for connecting a separate shaft to the shell member is fixed to the shell member by welding. In fixing the shaft connection pipe, the lower end is inserted to abut against the sole of the shell member.

Since this construction of the head involves connecting together two or three shell members as well as the shaft connection pipe, the large number of components means that the number of operations such as welding required in the manufacturing process becomes large so that costs are increased. Moreover, since the shaft connection pipe is a separate body, the strength of the shaft connection can also be a problem. Furthermore, the shaft connection pipe which protrudes in an upward direction from the top of the head has its lower end extending as far as the sole. Hence the weight of the front side of the head is increased by the shaft connection pipe. This increase in weight of the front side of the head, reduces the "sweet area". Here "sweet area" refers to a region on the face where a ball that is struck by this region flies stably and directly ahead. The "sweet area" can be increased by moving the overall center of gravity of the head further rearward (lowering the center of gravity).

With Japanese Utility Model Unexamined Publication No. 58-185252, although an iron club head is disclosed and not a wood club head, there is disclosed a container-shaped balance weight having an open front face connected to a rear face of a substantially planar face member which is formed integrally with a shaft connecting portion. The connection face of the face member and the balance weight is a planar face. With a construction such as that of this disclosure, the head is formed as two members, so that the number of members is reduced. However, since the positional relationship between the face and shaft for the iron club head differs from that for the wood club head, the construction disclosed in this publication cannot be applied as is to the wood club head.

With the conventional hollow metallic golf club wood head as described beforehand, the head body construction involves welding together the two or three shell members and the separate shaft connection pipe. Due to the large number of members, the number of operations in the manufacturing process becomes large, so that costs are increased. Moreover there can be problems due to the strength of the shaft connection being weak. Furthermore, since the lower end of the shaft connecting pipe extends as far as the sole, the weight of the front side of the head is increased, thus reducing the "sweet area".

SUMMARY OF THE INVENTION

The present invention addresses the above-mentioned problems and has as a primary object to provide a golf club wood head of fewer structural members, thus enabling a reduction in the number of manufacturing operations and a reduction in cost, and wherein the strength at the shaft connecting portion can be increased, the loft angle can be easily adjusted in manufacture, and which can have a lower center of gravity. It is a second object of the present invention to provide a golf club wood head wherein the structural members thereof can be easily connected together. It is yet a third object of the present invention to provide a golf club wood head wherein the weight distribution of the head can be easily set.

According to a first aspect of the invention directed towards achieving the primary object, there is provided a golf club wood head having a hollow metallic body with a face on a front surface thereof and a shaft connecting portion protruding upward from an upper portion of a heel side, the head comprising a substantially planar face member, and a container-shaped rear shell member having an open front face connected to a rear side of the face member, wherein the shaft connecting portion is integrally formed with the face member on an upper portion of a heel side thereof and protruding rearward therefrom, while a cut-out is formed in the rear shell member in a heel side on an upper face of a front side, for accommodating a lower portion of the shaft connecting portion formed on the face member.

According to a second aspect of the invention directed towards achieving the second object, a separate lower rear side part of the shaft connecting portion is formed on the rear shell member.

According to a third aspect of the invention directed towards achieving the third object, a recess is formed in a rear face of the face member.

The golf club wood head according to the first aspect of the invention is constructed with a container-shaped rear shell member connected to a rear side of a substantially planar face member, and a shaft connected to a shaft connecting portion which is formed integral with the face member. The shaft connecting portion is formed on an upper portion of the face member and protruding rearward therefrom, and when connecting the rear shell member to the face member, fits into the cut-out portion on the upper face on the front side of the rear shell member. The face member and the shaft connecting portion are thus formed in this way as a single unit. Since the face member is also of a simple planar shape, then when manufacturing for example by forging, the loft angle can be easily adjusted. Moreover, since the shaft connecting portion is at the top of the face member but not at the bottom, the front side of the head can be lightened. As a result, the center of gravity can be lowered and the "sweet area" increased.

With the golf club wood head according to the second aspect of the invention, the separate lower rear side part of the shaft connecting portion is formed on the rear shell member, and the connection line between the face member and the rear shell member is made as straight as possible. As a result, joining such as by welding can be carried out easily.

With the golf club wood head according to the third aspect of the invention, a recess is formed in a rear face of the face member. The weight distribution on the face side can thus be set by setting the location and size of the recess. For example, if the recess is located towards the heel side, the weight distribution of the head is off-set towards the toe side, giving a golf club suitable for a player who tends to slice. On the other hand, if the recess is located towards the toe side, the weight distribution of the head is off-set towards the heel side, giving a golf club suitable for a player who tends to hook.

Other objects, features and advantages of the invention will become apparent to those skilled in the art from the following description of the preferred embodiments of the invention, wherein reference is made to the accompanying drawings, in which:

DETAILED DESCRIPTION OF THE PREFERRED EMBODIMENTS

Figure 1:
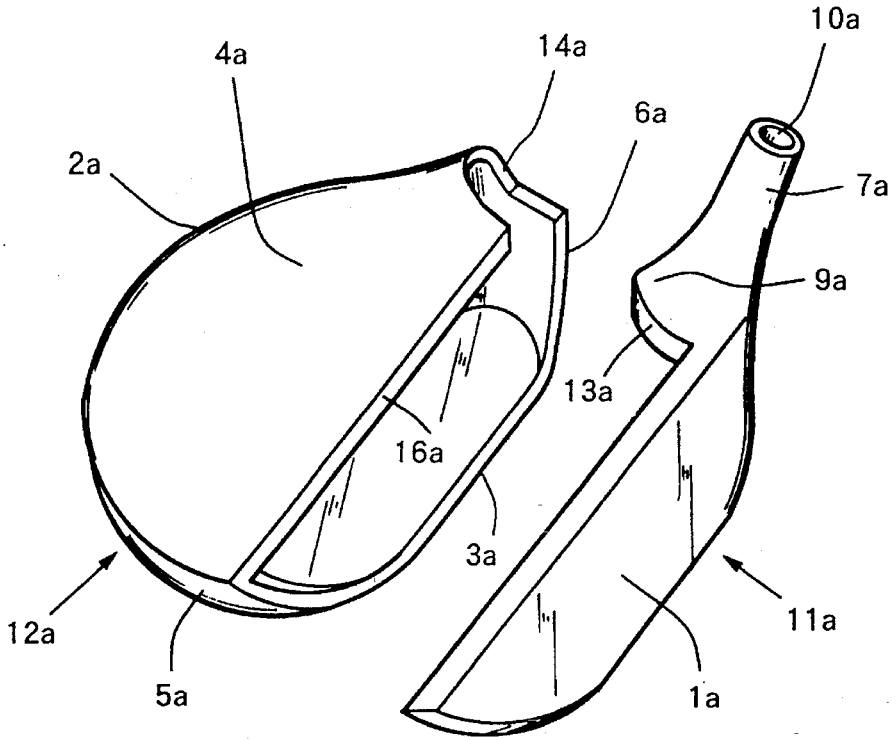
FIG. 1 is an exploded perspective view of a first embodiment of a golf club wood head of the invention.
Figure 2:
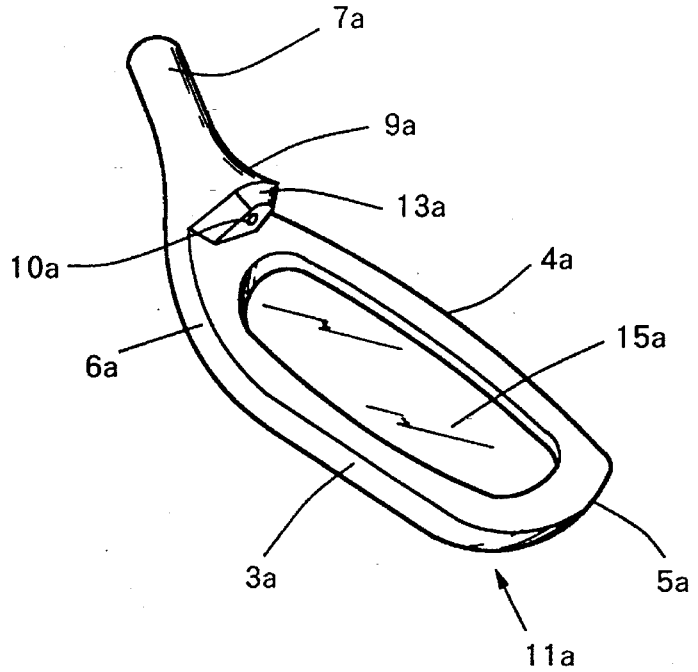
FIG. 2 is a perspective view of a rear side of a face member of the first embodiment.
Figure 3:
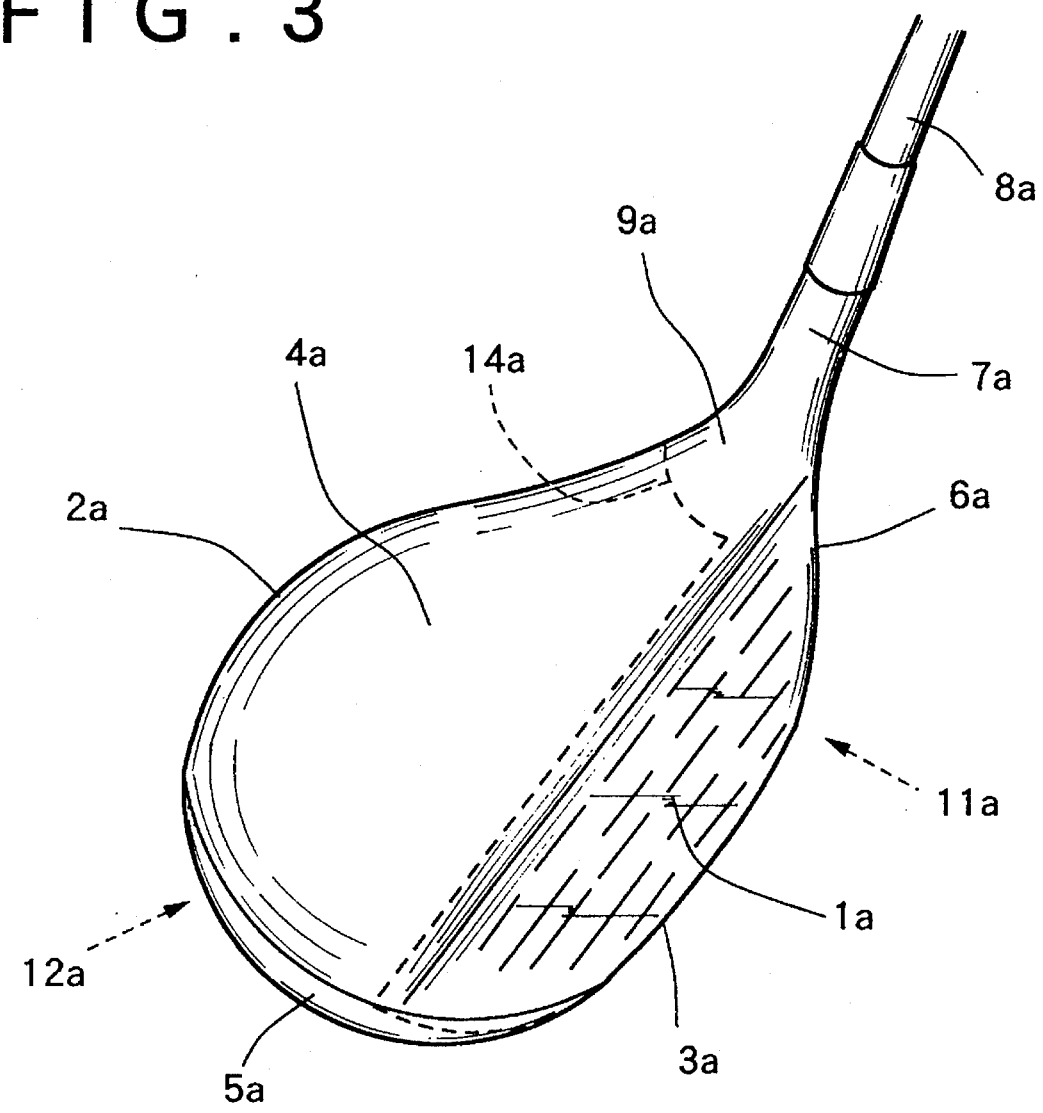
FIG. 3 is a perspective view of the manufactured overall head of the first embodiment.
Figure 4:
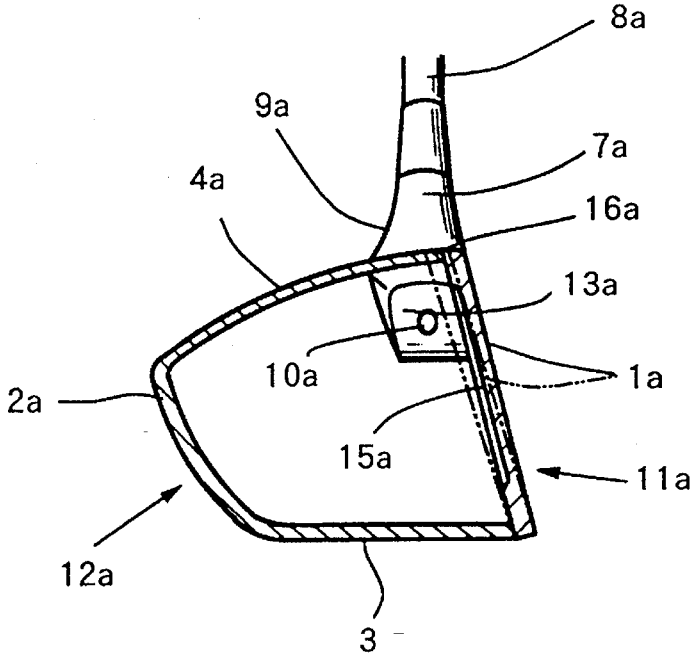
FIG. 4 is a cross-sectional view of the manufactured overall head of the first embodiment.

As follows is a description of a first embodiment of a golf club wood head according to the present invention with reference to FIG. 1 through FIG. 4. The golf club wood head of this embodiment is hollow and made of a metallic material. For the metal a variety of metals may be used such as pure titanium, titanium alloy (with a specific gravity of approximately 4.6), stainless steel, or some other light weight alloys. In the figures, reference numeral l*a* designates the face of a front side, 2*a* the back of a rear side, 3*a* the sole of a bottom side, 4*a* the top of an upper side, 5*a* the toe on one side, and 6*a* the heel on an other side. Extending upward from the heel 6*a* side is a tubular shaped shaft connecting portion (hosel) 7*a* to which is connected a shaft 8*a*. A lower portion of an outer peripheral face of the shaft connecting portion 7*a* comprises a curved face 9*a* formed so as to blend smoothly with the top 4*a*, the face 1*a* and the heel 6*a*, while a through-hole 10*a* for receiving for example a connecting portion of the shaft 8*a*, is formed in the shaft connecting portion 7*a*.

The head body is divided into two parts; a substantially planar face member 11*a* having the face l*a* and the shaft connecting portion 7*a*; and an open faced container-shaped rear shell member 12*a* having the other portions of the head. The head body is constructed by welding the rear shell member 12*a* to the rear side of the face member 11*a*. The upwardly protruding shaft connecting portion 7*a* is integrally formed on the upper portion of the heel 6*a* side of the face member 11*a* and protruding rearward therefrom, while a cut-out 14*a* is formed in the rear shell member 12 *a* in the heel 6 *a* side on the upper face of the front side thereof. This cut-out 14*a* accommodates a base portion 13*a* at the lower side of the shaft connecting portion 7*a* formed on the face member 11*a*. The rear surface of the face member 11*a* with the exception of the periphery, is formed with a recessed portion 15*a*.

The face member 11*a* including the shaft connecting portion 7*a*, and the rear shell member 12*a* are basically fabricated by die-forging. However, parts such as the through-hole 10*a* in the shaft connecting portion 7*a*, can for example be machined after forging as necessary. Furthermore, the rear shell member 12*a* may have undercut configurations in optional directions. However even with a rear shell member 12*a* having such a configuration, this can be formed without problems by multistage die-forging.

The face member 11*a* and the rear shell member 12*a* thus fabricated are then welded together. At this time, the base 13*a* of the shaft connecting portion 7*a* formed on the face member 11*a* is fitted into the cut-out 14*a* provided in the rear shell member 12*a*. After welding the face member 11*a* to the rear shell member 12*a*, a filler such as foamed urethane may be introduced as necessary into the head via the through-hole 10*a* in the shaft connecting portion 7*a*. After this the shaft 8*a* is connected to the shaft connecting portion 7*a*.

With the construction of the above-mentioned embodiment, the head body comprises two members: the face member 11*a* including the shaft connecting portion 7*a*; and the rear shell member 12*a*. The number of members can thus be reduced so that the number of operations in the manufacturing process can be minimized with a saving in costs. Furthermore, since the shaft connecting portion 7*a* is integrally formed with the face member 11*a*, the strength of the shaft connecting portion 7*a* can be increased compared to welding a separate member to the face member 11*a*. Hence the connection strength of the shaft 8*a* can be increased, Moreover, since the face member 11*a* needs to be stronger than the other parts, necessitating the comparatively large thickness thereof, then as well as increasing the strength of the shaft connecting portion 7*a* there is the further advantage of increased strength of the face member 11*a*.

Although the strength of the shaft connecting portion 7*a* is ensured in the above manner, it should be noted that the shaft connecting portion 7*a* only extends to the upper portion of the face member 11*a*, and not to the lower portion, which enables the lightening of the front side of the overall golf club head. Accordingly, the rear side of the overall head can be weighted, corresponding to the lightening of the front side. As a result the center of gravity of the overall head can be lowered, thereby enlarging the sweet area. In this respect, the rear portion inside the rear shell member 12*a* may be integrally formed with a weight, or else a separate weight may be welded thereto.

With the above construction, a loft angle (that is, the angle of the face 1*a* to a vertical plane) can also be adjusted by the angle-setting of the shaft connecting portion 7*a* to the face 1*a*, and since the face member 11*a* is a simple planar shape, then this setting can be easily and correctly attained during manufacture. In this respect, the adjustment of the loft angle with respect to the face member 11*a* can be performed at each stage of a plurality of forging processes. In addition, after the forging process, a sizing process may be performed using a sizing press to give the final configuration and size of the face member 11*a*. In this sizing process also, the loft angle may be adjusted. Moreover, since the face member 11*a* is of a simple planar form, the loft angle can be adjusted by shaving off the front edge 16*a* of the upper or side surface of the rear shell member 12*a* as shown by the chain line in FIG. 4, using a machine such as a laser beam machine. Being able to adjust the loft angle in this way by a number of operations during manufacture is also advantageous for the accurate setting of the loft angle.

Furthermore, since the rear surface of the face member 11*a*, with the exception of the periphery, is formed with the recessed portion 15*a*, the weight distribution of the head is more concentrated around the periphery of the face 1*a*, so that the "sweet area" is enlarged.

Additionally, when forming the recess on the rear face of the face member, for example by forging, the number, size, location or depth of the recesses can be optionally and easily chosen, thus enabling the easy and optional setting of the weight distribution at the face side of the golf club head depending on the above choice.

Figure 5:
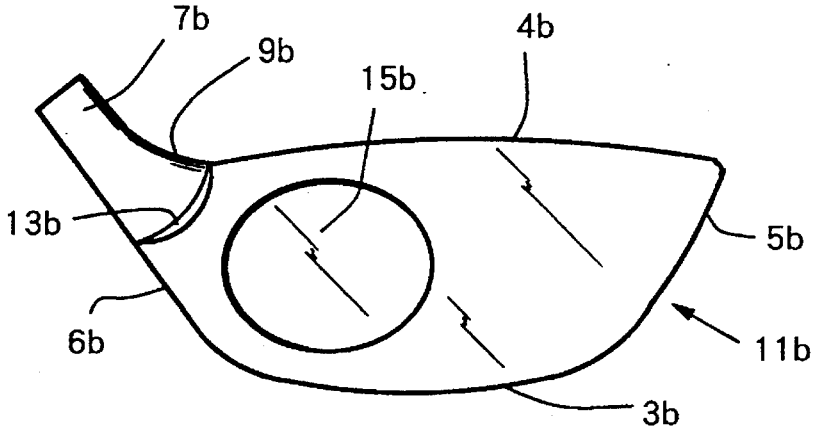
FIG. 5 is a rear view of a face member of a second embodiment of a golf club wood head of the invention.
Figure 6:
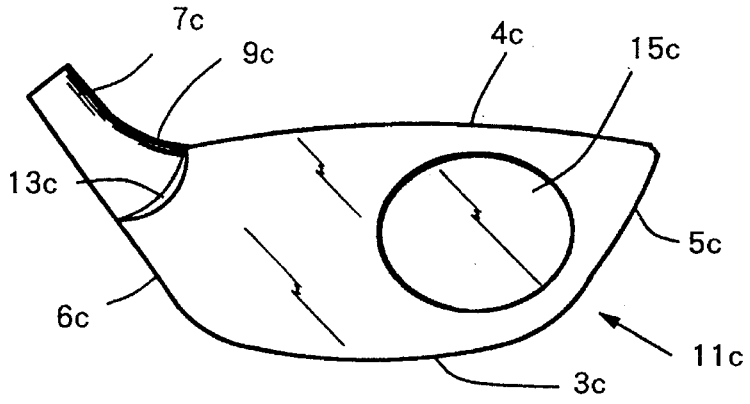
FIG. 6 is a rear view of a face member of a third embodiment of a golf club wood head of the invention.
Figure 7:
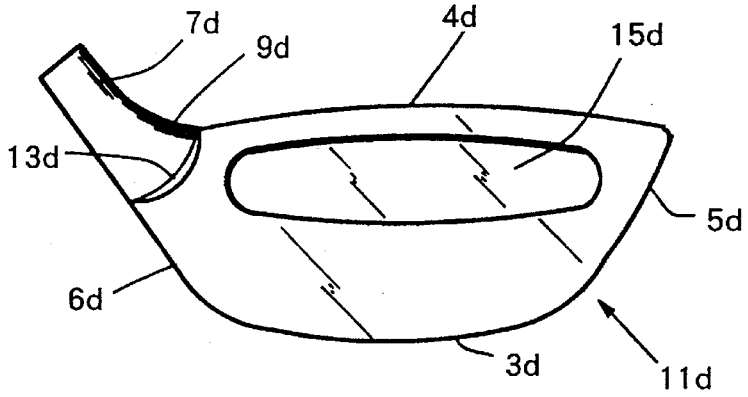
FIG. 7 is a rear view of a face member of a fourth embodiment of a golf club wood head of the invention.

In this respect second, third and fourth embodiments will now be described with reference to FIG. 5 through FIG. 7. In FIG. 5, FIG. 6, and FIG. 7 components corresponding to the components of the first embodiment are indicated by the same numerals with respective suffixes "b", "c", "d" added. Similarly in FIG. 8 to be discussed later in relation to a fifth embodiment, suffix "e" is added.

In the second embodiment shown in FIG. 5, the heel 6*b* side of the rear face of the face member 11*b* is formed with a recess 15*b*. Whereas, in the third embodiment shown in FIG. 6, a toe 5*c* side of the rear face of the face member 11*c* is formed with a recess 15*c*. Furthermore, in the fourth embodiment shown in FIG. 7, the upper side of the rear face of the face member 11*d* is formed with a recess 15*d*.

If as in the second embodiment, the recess 15*b* is located towards the heel 6*b* side, the weight distribution of the head is off-set towards the toe 5*b* side, giving a golf club suitable for a player who tends to slice. On the other hand, if as in the third embodiment the recess 15*c* is located towards the toe 5*c* side, the weight distribution of the head is off-set towards the heel 6*c* side, giving a golf club suitable for a player who tends to hook. Furthermore, if as in the fourth embodiment the recess 15*d* is located towards the top, the center of gravity can be further lowered thus helping to lift the ball giving an increase in range.

Figure 8:
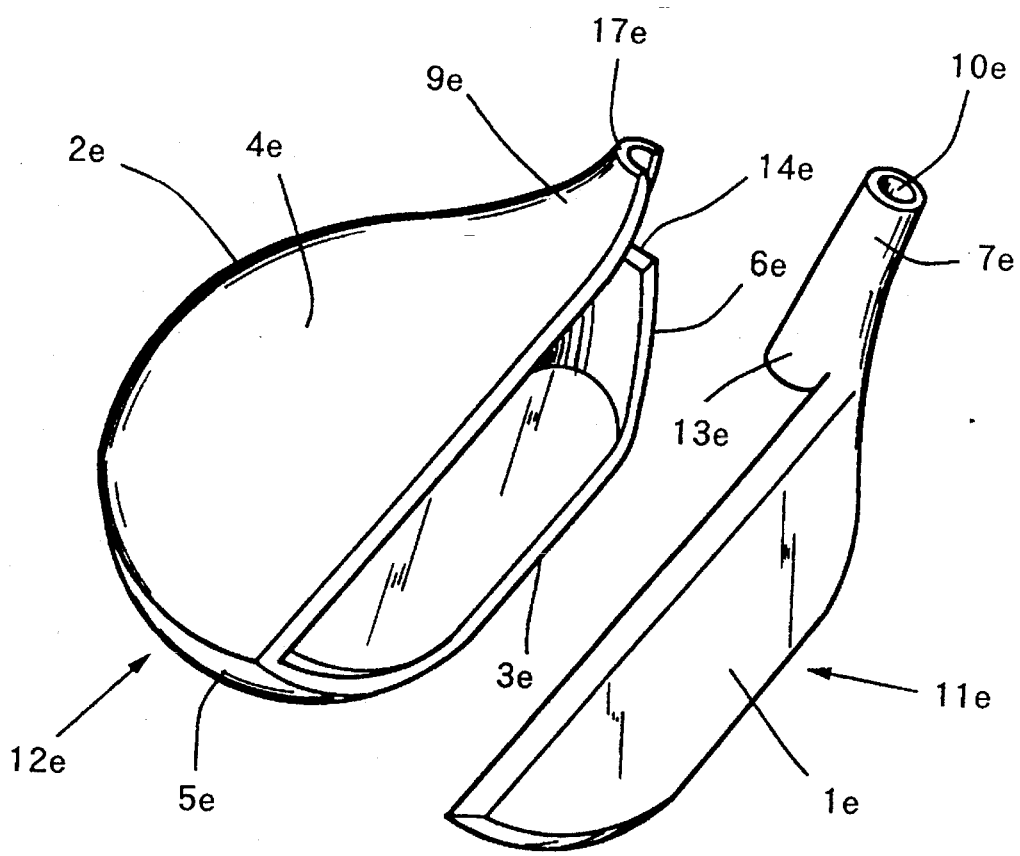
FIG. 8 is an exploded perspective view of a fifth embodiment of a golf club wood head of the invention.

In FIG. 8, showing the fifth embodiment of the golf club wood head of the present invention, most parts of the shaft connecting portion 7*e* are still integrally formed on the face member 11*e*. However, a lower rear side 17*e* of the shaft connecting portion 7*e* is integrally formed on the rear shell member 12*e* in addition to the cut-out 14*e* for accommodating the lower portion of the shaft connecting portion 7*e* formed on the face member 11*e* side. As a result, the line of abutment of the face member 11*e* with the rear shell member 12*e* will be approximately a straight line or a plane, thereby simplifying the welding of the face member 11*e* to the rear shell member 12*e*. The lower rear side 17*e* of the shaft connecting portion 7*e* may be integrally formed on the rear shell member 12*e* at the time of forging, or may be formed as cladding at the time of welding.

The present invention is not limited to the before-mentioned embodiments, but also encompasses various modifications. For example with the before-mentioned embodiments, both the face member and the rear shell member were forged. However, either one or both may be forged. Moreover, with the before-mentioned embodiments, the hole in the shaft connecting portion for connection of the shaft is formed as a through-hole. However, this hole need not necessarily pass right through.

With the first aspect of the invention, the wood club head is constructed with a container-shaped rear shell member having an open front face connected to a rear side of a substantially planar face member. The shaft connecting portion is integrally formed with the face member on an upper portion of a heel side thereof and protruding rearward therefrom, while a cut-out is formed in the rear shell member in the heel side of the front side upper face, for accommodating a lower portion of the shaft connecting portion formed on the face member. As a result the number of structural members can be reduced, giving a reduction in the number of manufacturing operations and a reduction in cost. Furthermore, since the shaft connecting portion is integrally formed on the face member, the strength of the shaft connecting portion can be increased, and since the face member is of simple planar form, it can be manufactured for example by forging, and the loft angle can be easily adjusted. In addition, since the design is such that the shaft connecting portion need only be provided on the upper portion of the face member, the front side of the head can be lightened, and the center of gravity can be lowered, thereby enlarging the sweet area.

With the second aspect of the invention, since the lower rear side part of the shaft connecting portion is formed on the rear shell member, the line of abutment of the face member with the rear shell member will be approximately a straight line or a plane, thereby simplifying the joining, by welding and the like, of the face member to the rear shell member.

With the third aspect of the invention, a recess is formed in a rear face of the face member, thus facilitating the setting of the weight distribution of the head.

What is claimed is:

1. A golf club wood head having a hollow metallic body with a face on a front surface thereof and a shaft connecting portion protruding upward from an upper portion of a heel side, said head comprising: a substantially planar face member, and a container-shaped rear shell member having an open front face connected to a rear side of the face member, wherein said shaft connecting portion is integrally formed with said face member on an upper portion of a heel side thereof and protruding rearward therefrom, while a cut-out is formed in said rear shell member in a heel side on an upper face of a front side thereof, for accommodating a lower portion of the shaft connecting portion formed on said face member.

2. A golf club wood head as claimed in claim 1, wherein a separate lower rear side part of said shaft connecting portion is formed on said rear shell member.

3. A golf club wood head as claimed in either of claim 1 and claim 2, wherein a recess is formed in a rear face of said face member.

* * * * *